United States Patent [19]

Finnigan, III

[11] 4,279,416

[45] Jul. 21, 1981

[54] JUGGLING CLUB

[76] Inventor: Oliver D. Finnigan, III, 23004-107th Place W., Edmonds, Wash. 98020

[21] Appl. No.: 56,717

[22] Filed: Jul. 11, 1979

[51] Int. Cl.[3] ..... A63B 15/00

[52] U.S. Cl. ..... 272/124

[58] Field of Search ..... 272/117, 124, 122; 273/72 R, 82 R

[56] References Cited

U.S. PATENT DOCUMENTS

| | | | |
|---|---|---|---|
| 1,385,642 | 7/1921 | Restein | 272/122 |
| 1,399,071 | 12/1921 | Nowak | 272/124 |
| 1,930,342 | 10/1933 | Graham | **272/124** |

[58] Field of Search ..... 272/117, 124, 122; 273/72 R, 82 R

[56] References Cited

U.S. PATENT DOCUMENTS

| | | | |
|---|---|---|---|
| 1,385,642 | 7/1921 | Restein | 272/122 |
| 1,399,071 | 12/1921 | Nowak | 272/124 |
| 1,930,342 | 10/1933 | Graham | 272/124 X |
| 3,169,766 | 12/1965 | Ernst | 273/82 R |

*Primary Examiner*—Richard C. Pinkham
*Assistant Examiner*—William R. Browne
*Attorney, Agent, or Firm*—Keith D. Beecher

[57] ABSTRACT

A juggling club is provided which is composed of a sturdy hollow one-piece molded plastic body formed with a bulged end for receiving a tapered resilient knob, and also formed with a notched end for receiving a resilient tip. The body is formed of, for example, polyethylene, and it is inexpensive in its construction since it does not include a dowel pin, or the like, extending through the club for supporting the knob and tip at the opposite ends of the body.

2 Claims, 4 Drawing Figures

JUGGLING CLUB

BACKGROUND

As is well known, juggling is the art of throwing objects into the air one after the other and catching them rapidly. The objects include, for example, balls, hoops, plates, rings, clubs, and the like; the expert juggler using, for example, from two to as many as ten or twelve objects at a time.

The prior art juggling club, for the most part, is somewhat complicated and expensive in its construction, since it is usually composed of an elongated body member, shaped as a kingpin, with a knob at one end, and a tip at the other end, the knob and tip being mounted and held at the ends of the body by a dowel pin which extends through the body from one end to the other.

The present invention provides a juggling club which has all the attributes of the prior art juggling club, but which is easier and less expensive to make, and which may be sold at a relatively low price.

In the juggling club of the present invention, the need for the dowel pin is eliminated, and the body is formed of an appropriate plastic material shaped at each end for holding the knob and tip of the club without the need for the dowel pin or additional attaching means.

DETAILED DESCRIPTION OF THE ILLUSTRATED EMBODIMENT

Figure 1:
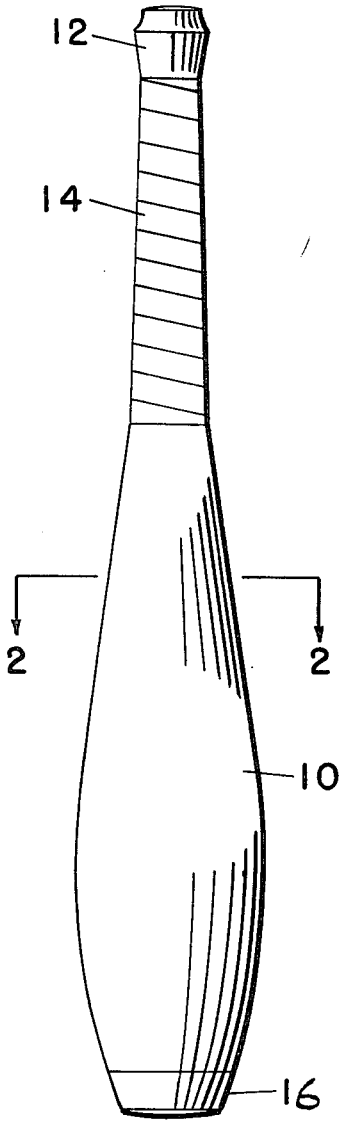
FIG. 1 is an elevational view of a juggling club constructed in accordance with one embodiment of the invention.
Figure 2:
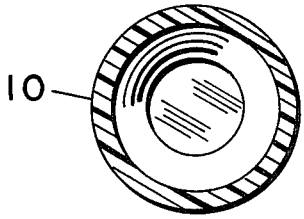
FIG. 2 is a section taken along the line 2—2 of FIG. 1.

As shown in the drawing, the juggling club of the invention includes an elongated, hollow body 10 which is constructed to have a kingpin configuration, and which, for example, may be molded as a hollow member formed of appropriate plastic such as polyethylene, or similar material. The club of the invention may have a weight, for example, of the order of 8 ounces; and a length, for example, of 18 inches.

Figure 3:
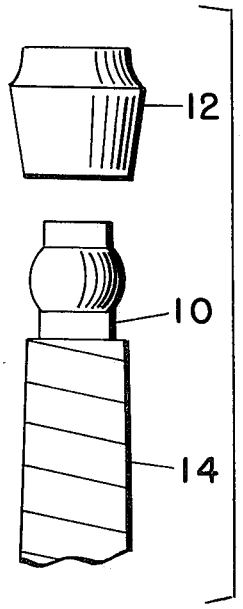
FIG. 3 is a fragmentary view of the upper end of the club of FIG. 1, showing the tapered knob at one end of the club in a detached position.

One end of the body 10 has a bulged configuration, as best shown in FIG. 3, which serves to receive a resilient knob 12 formed, for example, of resilient plastic, or equivalent material. The knob 12 is fitted over the bulge at the end of the body 10, and is held firmly in place, without the need for any additional attaching means.

The body defines a handle portion adjacent to the knob 12, and a tape 14 is spirally wound about the handle portion, in accordance with usual practice. The knob 12, as shown, is tapered toward the handle portion, so that there will be no shoulder, or other impediment to the easy handling of the club.

Figure 4:
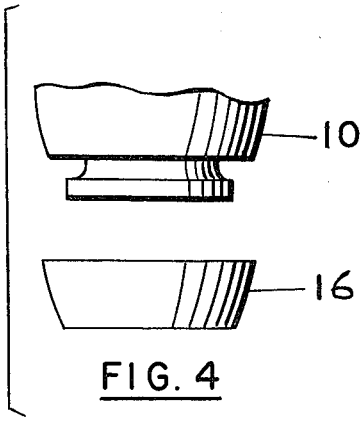
FIG. 4 is a fragmentary view of the other end of the club of FIG. 1, showing the tip at that end in a detached position.

A tip 16 is mounted at the other end of the body 10, and it, likewise, may be formed of appropriate resilient material, such as resilient plastic, rubber or the like. The tip 16 is mounted and supported on the other end of body 10 by having an internal peripheral lip which is received in a peripheral groove, as shown in FIG. 4.

Therefore, the club of the present invention is simple and inexpensive in its construction, and is constructed so that the knob 12 and tip 16 may be firmly supported on either end of the body 10, without the need for a dowel pin, or other attaching means.

It will be appreciated that although a particular embodiment of the invention has been shown and described, modifications may be made. It is intended in the claims to cover the modifications which come within the spirit and scope of the invention.

What is claimed is:

1. A juggling club comprising a onepiece molded plastic body in the configuration of a kingpin; and a hollow knob formed of resilient material mounted at one end of the body, in which said one end of the body has a bulged portion at the end thereof for receiving the knob with the end of the knob extending down over and covering said bulged portion, said body defining a handle portion adjacent to the bulged portion, and said knob having a tapered configuration extending toward the handle portion, and which includes a cupshaped tip member formed of resilient material mounted at the other end of the body and having an internal peripheral lip, and in which said other end of said body has a peripheral groove for receiving the peripheral lip of the tip member and constituting the sole support for said tip member.

2. The juggling club defined in claim 1, and which includes a tape spirally wrapped around the handle portion.

* * * * *